US005441306A

United States Patent [19]

Green

[11] Patent Number: 5,441,306

[45] Date of Patent: Aug. 15, 1995

[54] SKIER'S POLE

[76] Inventor: Thomas F. Green, R.F.D. #1 (box 66B), Council Bluffs, Iowa 51503

[21] Appl. No.: 203,304

[22] Filed: Mar. 1, 1994

[51] Int. Cl.[6] ..... A63C 11/22

[52] U.S. Cl. ..... 280/819; 280/821; 2/160; 2/162

[58] Field of Search ..... 280/819, 821, 822, 809; 2/159, 160, 161 R, 161 A, 162, 170

[56] References Cited

U.S. PATENT DOCUMENTS

| | | | |
|---|---|---|---|
| 3,746,356 | 7/1973 | Shipstad | 280/821 |
| 3,874,686 | 4/1975 | Shipstad et al. | 280/821 |
| 4,572,545 | 2/1986 | Dooley, Jr. et al. | 280/821 |
| 5,123,674 | 6/1992 | Bagneres et al. | 280/821 |

FOREIGN PATENT DOCUMENTS

| | | | |
|---|---|---|---|
| 2306237 | 8/1974 | Germany | 280/821 |

*Primary Examiner*—Richard M. Camby
*Attorney, Agent, or Firm*—George R. Nimmer

[57] ABSTRACT

Vertically extendable ski-poles for snow skiers and conventionally having an enlarged topical handgrip are thereat herein attachably provided with a novel hand-protector structure including therewithin a hood member surroundably vertically flankably attached to the handgrip and extending rearwardly therefrom along a horizontal-axis toward a semi-rigidified hood rearward portion. Attached along the hood member adjacent the rear-end thereof is an elastic cuff member having a normal-condition away from the skier's wrist during favorable weather conditions and having a rearward-condition implantable against the skier's wrists during frigid weather conditions.

9 Claims, 2 Drawing Sheets

SK
8B
20
8A
9
10
HW
7
2
8
8C
23
8E
28
29
31
30W
19
39
10H
30
H

SKIER'S POLE

BACKGROUND OF THE INVENTION

Snow skier's traditionally employ ski-poles uprightly extendable along a vertical-axis effected whenever the skier's usually-gloved hand graspably wields the topical handgrip portion of a conventional ski-pole. The handgrip uppermost portion occupies a minor proportion of the ski-pole vertical-height and includes a handgrip top-end overlying a handgrip bottom-end. Snow skiers' usually-gloved hands are frequently confronted with melting snow whereby their ski-pole wielding hands become inflicted with low-temperature dampness that is inimical to the skier's comfort, safety, and skiing performance.

GENERAL OBJECTIVE OF THE INVENTION

It is accordingly the general objective of the present invention to provide method and hand-protector structure for conventional ski-poles and for thereby mitigating various adverse affects from manually-inflicted melting snow and including mitigating discomforture to, danger to, and inferior aki-performance by the skier. Ancillary objectives include ski-pole hand-protector structures that: are readily attachable to the topical handgrip portion of variously styled conventional ski-poles are normally repulsive of environmental dampness but that permit cooling and perspirational emission therethrough and that can be selectively efficaceously utilized in various ambient environmental weather conditions.

GENERAL STATEMENT OF THE INVENTION

With the above-mentioned general and ancillary objectives in view, the novel Skier's Pole concept of the present invention comprises a novel hand-protector device in phsically attached combination with a selectable conventional ski-pole extandable along a vertical-axis and topically provided with an upright handgrip portion, and comprising: flankably attached to the ski-pole upright handgrip and in shrouding relationship thereto, a generally horizontally extending hood member that is rearwardly semi-rigidified, and preferably also including a surrounding elastic rearward cuff member having a selectable rearward-condition protectably surrounding the skier's wrist during frigid weather conditions. Various means are suggested for implementing the hood and cuff members in attachment; with the ski-pole upright handgrip, including, inter-alia, lowerably slotting the rearwardly rigidified hood members, and together with other optionally employable features that will be suggested from the ensuing description of this patent application.

BRIEF DESCRIPTION OF THE DRAWING

In the drawing, wherein like characters refer to like parts in the several views, and in which.

DETAILED DESCRIPTION OF THE DRAWING

Figures 1, 1A, 1B:
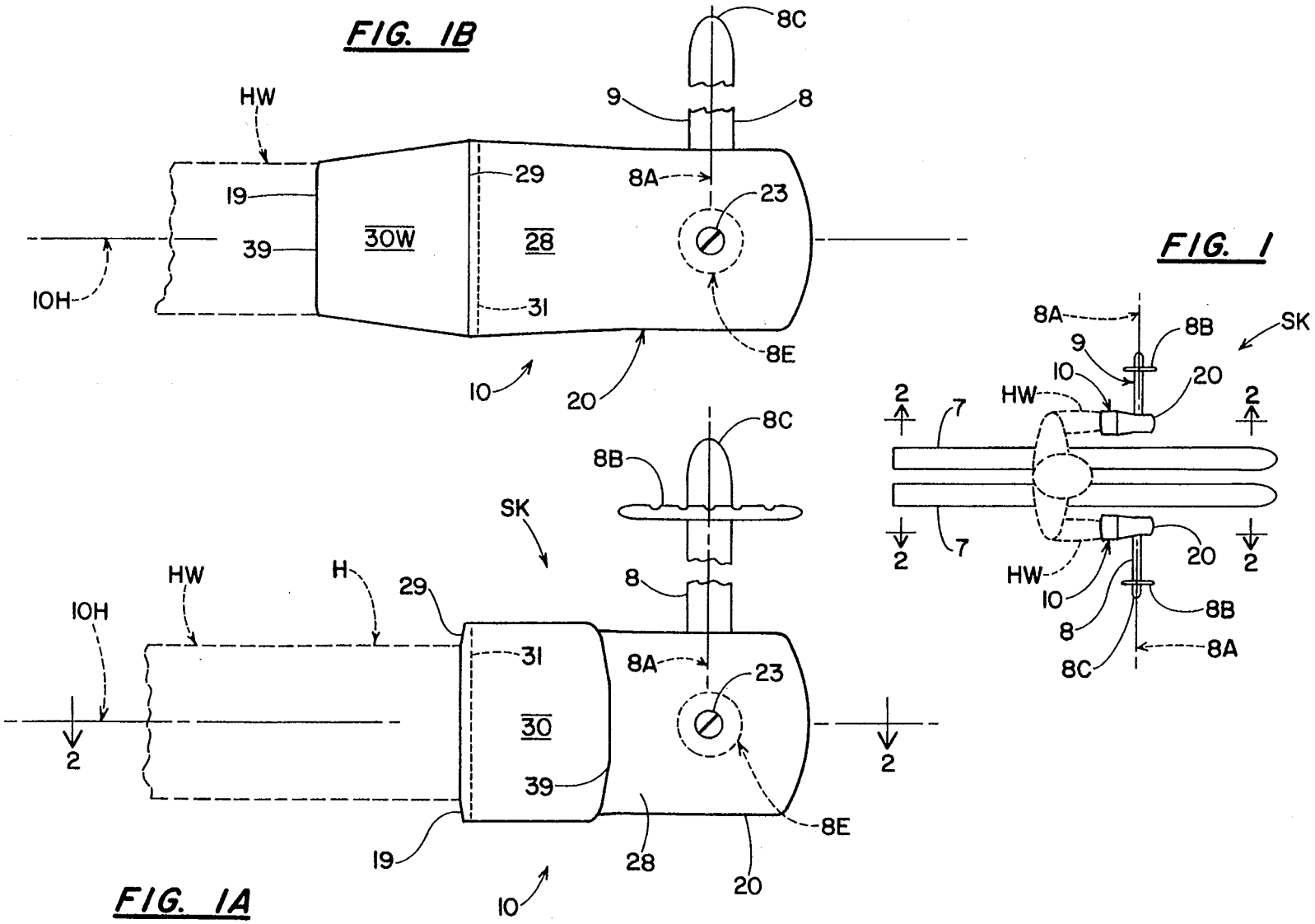
FIG. 1 is a top plan view of a human skier having his/her head, shoulders, and ski-poles' engaging forearms and wrists (HW), all depicted in phantom lines; and with terrain-engaging skis (7) and representative embodiment skier's pole ("SK") depicted in solid lineal
FIG. 1A is a detail view of the FIG. 1 top plan view and particularly showing the novel skier's pole cuff member portion (30) in a normal-condition i.e. forwardly and non-engaged with the skier's wrists.
FIG. 1B is akin to FIG. 1B but wherein the cuff member portion is in a rearward-condition (30W) i.e. to circumferentially engage the skier's wrist ("HW") during more-frigid weather.

The herein-titled "Skier's Pole having Capability of Protecting the Skier's Hand" ("SK") comprises a conventional ski-pole (e.g. 8) having its handgrip topical zone (e.g. 8E–8F) affirmatively attached (e.g. at 22, 23) to a hand-protector portion (e.g. 10) of the novel "Skier's Pole" (e.g. "SK").

Conventional ski-poles (8) extend uprightly along a vertical-axis (8A) between a lower-end (8C) and an upright topical handgrip zone extending between handgrip top-end BE and handgrip bottom-end 8F. Usually surrounding vertical-axis 8A immediately above lower-end 8C is a so-called "ski-pole 'basket'" (8B).

Having now described the conventional ski-pole portion (e.g. 9, 8) of the novel skier's pole ("SK"), a representative embodiment (e.g. 10) of the novel skier's pole's hand-protector portion will next be described, and thus, will be seen to comprise a hood member 20 of air-permeable flexible fabric structural material having a forward portion that shroudably flanks the ski-pole top-end (8E) and bottom-end (8F) and that is affirmatively attached to the ski-pole handgrip. In the latter vein, a screw (23) might be utilized to attach hood member 20 and intervening stiffener part 26) to handgrip top-end 8E, and as by "Velco" means 22 between ski-pole (9, 8) and forward-lower extension 21 of hood member 20. Hood member 20 surrounds a directionally longitudinal horizontal-axis 10H and includes a rearward-portion 28 thereof having a rear-end 29 transversely intersecting horizontal-axis 10H. Hood rear-end 29 might well provide the hand-protector's rear-extremity (19). Accordingly, the instant paragraph provides and describes an ultra-rudimentary embodiment skier's pole ("SK") that enables a skier's fingers ("HF") to be inserted through hood member 20 and therein along horizontal-axis 10H to grasp the ski-pole handgrip and there be hand-protected from the ambient weather conditions, And preferably, the hood member rearward portion (28) should be semi-rigidified (e.g. internal gusset 25) so as to facilitate manual entry ("HF") forwardly along horizontal-axis 10H from 19, 29, for engagement with the ski-pole handgrip. In this vein, herein disclosed is hood rearward portion stiffener part 25 of semi-rigid structural material which at its rearward-part 27 is closely surrounded by hood rearward portion 28 and rearwardly attached thereto (e.g. by sewing 31) and which stiffener has a said top-frontal extension 26. And for purposes to be explained later, the hood member 20 and the internal annular stiffener 25, along a vertical-plane below horizontal-axis 10H, are each slottably interruptedly disjoined at 28A and at 25A, respectively.

Figure 2:
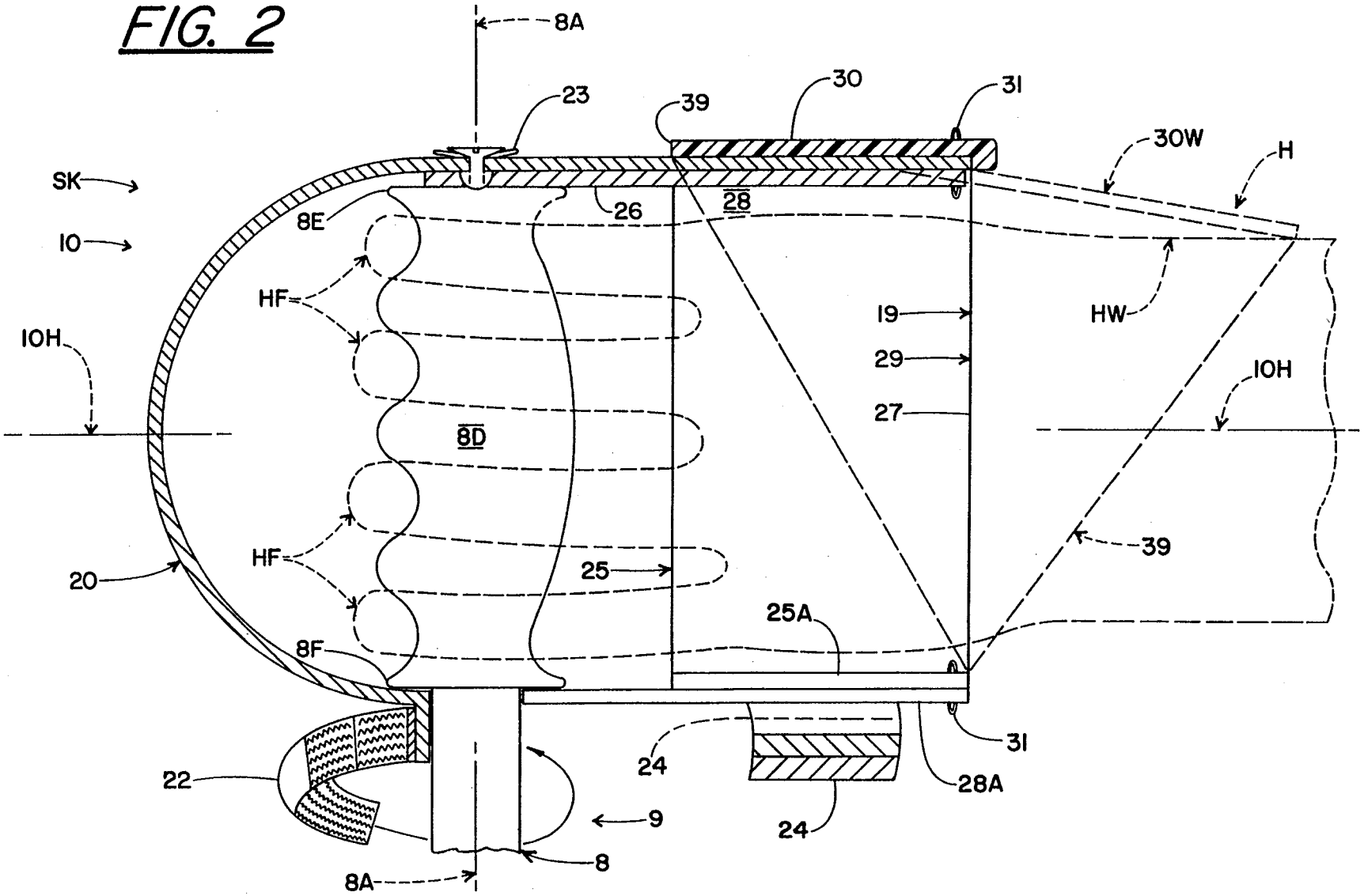
FIG. 2 is a sectional elevational view taken along lines 2—2 of FIGS. 1 and 1A.

Though the ultra-rudimentary skier's pole embodiment described in the immediately preceeding paragraph is fully adequate for protecting the skier's hands during moderately hospitable winter conditions, a rearwardly elasticably extendable cuff member (e.g. 30) might be selectably employable against the skier's wrists ("HW") during very-frigid weather conditions. Accordingly, and as alluded to in drawing FIG. 2, an annular cuff member (30) of elastic structural material might be circumferentially attached (e.g. by annular sewing 31) immediately adjacently forwardly hood rear-end 29 and having two cuff conditions, namely:

(A) a cuff member normal-condition surrounding the hood member rearward portion (28) ancillary for hand-insertion and usage during moderate weather conditions; and (B) a cuff member rearward-condition (30W) extendable rearwardly from the hood member and there adapted to elasticably surround the skier's wrist ("HW") during frigid weather conditions.

Preferably, the cuff member rearward-extremity 39 extends obliquely downwardly-forwardly to facilitate the skier's manually-induced changers between cuff member normal-condition and wrist-engaging rearward-condition (30W).

So as to enable attachable installation of (e.g. 22, 23) of the topically-enlarged ski-pole component (e.g. 8.9) within the novel hand-protector component (e.g. 10) of the herein-inventive "Skier's Pole", the following representative installation techniques are suggested:

(i) if the ski-pole lower-basket (8B) is readily removable and replaceable: by serially inserting the lower-end (8C) of a temporarily basketless ski-pole horizontally through the hand-protector rear-extremity (19,29, 39) &thence downwardly through the hood forward-lower open extension (21). Thence, the ski-pole to hand-protector attachment means (e.g. 22, 23) can be effected and/or (ii) if the ski-pole lower-basket (8B) is not readily removable, by taking advantage of the hood member and cuff member lower-slotted disjoinders (28A, 25A) to enable the ski-pole upright handgrip portion (8E–8F) to be moved unobstructively directionally longitudinally along horizontal-axis 10H, whereupon the hand-protector attachment means (e.g. 22, 23) can be implemented. And thereafter, the hand-protector at hood member lower-slot disjoinder 28A is desireably removably re-joinable by usage of "Velcro"-hood, 24, or equivalent re-joinable means.

From the foregoing, the construction, operation and usage of the "skier's pole having capability of protecting the skier's hand" will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Skier's pole having the capability of protecting the skier's hand and comprising: a selectable ski-pole uprightly extending along a vertical-axis thereof and topically provided with an upright handgrip uppermost portion having a top-end vertically overlying a bottom-end therefor and further comprising a bottom-end therefor and further comprising herein a hand-protector attached in shrouding relationship to the ski-pole handgrip uppermost portion and extending directionally horizontally longitudinally rearwardly from the handgrip portion along a horizontal-axis, and said hand-protector portion of said selectable ski-pole comprising:

(A) attached to said selectable ski-pole and in surrounding relationship to the handgrip upper portion thereof, a hood member of flexible structural material that vertically flanks said handgrip top-end and bottom-end and that extends directionally longitudinally rearwardly from said handgrip to rearwardly terminate as a hood member rear-end that substantially surrounds said horizontal-axis, said hood member having a rearward portion extending directionally longitudinally forwardly from said rear-end and being of physical property to be sufficiently semi-rigid about said horizontal-axis to permit a skier's hand to be readily inserted directionally longitudinally forwardly along said horizontal-axis for readily manually grasping said skier's pole upright handgrip uppermost portion; and (B) a cuff member being provided of an elastic material that has physical properties differing from that of said hood member and being permanently surroundably pivotably attached to said hood member immediately adjacent the hood member rear-end and thereat being adapted to alternatively assume: a cuff member normal-condition substantially surrounding the hood member rearward portion for usage during temperate weather sking conditions; and also adapted to assume a cuff member rearward-condition extending pivotably rearwardly of the hood member rear-end for thereby protecting the skier's hand rearward areas during usages in frigid weather conditions.

2. The skier's pole of claim 1 wherein the handgrip hand-protector at the hood member and immediately forwardly adjacent the hood member rear-end is provided with a distinct stiffener member layer substantially surrounding said horizontal-axis and for thereby maintaining said hood member semi-rigid condition about said hood member horizontal-axis.

3. The skier's pole of claim 2 wherein along a vertical-plane passing along said horizontal-axis, the hood member and cuff member are disjoined (but removably re-joinable) to permit ready, and longitudinally-forward attachable combination of the hand-protector to be longitudinally forwardly moved for attachable engagement with the skier's pole upright handgrip uppermost portion.

4. The skier's pole of claim 2 wherein said hood member is affirmatively attached to the handgrip top-end; and wherein the hood member is also conventionally removably attached to the conventional ski-pole immediately below the handgrip bottom-end thereof.

5. The skier's pole of claim 4 wherein said hood member is attached with screw means to the top-end of a conventional ski-pole handgrip; and wherein the hand-protector hood member is removably attached with skipole-Velcro means to said conventional skier's pole immiately below the handgrip bottom-end.

6. The skier's pole of claim 5 wherein the hood member and cuff member lower disjoinders are removably connectable with hood-member lower-plane-Velcro means.

7. The skier's pole of claim 2 wherein the distinct stiffener member layer takes the form of a laminar internal gusset that is attach-to and is surrounded by said hood member.

8. The skier's pole of claim 3 wherein there is an internal laminar gusset stiffener member for the hood member rearward portion and which internal laminar gusset includes a top-frontal extension overlyingly attached to the handgrip upper portion, and the remainder of said internal laminar gusset extending toward, but being relegated away from, said hood member lower disjoined portion.

9. The skier's pole of claim 4 wherein there is an internal laminar gusset stiffener member for the hood member rearward portion and which laminar internal gusset includes a top-frontal extension overlyingly attached to the handgrip upper portion, and the remainder of said internal laminar gusset extending toward, but being relegated way from, said hood member lower disjoined portion.

* * * * *